US007592589B2

(12) United States Patent
Hashimoto et al.

(10) Patent No.: US 7,592,589 B2
(45) **Date of Patent: *Sep. 22, 2009**

(54) METHOD OF MASS SPECTROMETRY AND MASS SPECTROMETER

(75) Inventors: Yuichiro Hashimoto, Tachikawa (JP); Hideki Hasegawa, Tachikawa (JP); Takashi Baba, Kawagoe (JP); Izumi Waki, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 221 days.

This patent is subject to a terminal disclaimer.

(21) Appl. No.: 11/716,615

(22) Filed: Mar. 12, 2007

(65) Prior Publication Data

US 2007/0181804 A1 Aug. 9, 2007

Related U.S. Application Data

(62) Division of application No. 11/631,033, filed on Dec. 28, 2006.

(51) Int. Cl.
*H01J 49/42* (2006.01)

(52) U.S. Cl. ..... 250/292

(58) Field of Classification Search ..... 250/281, 250/282, 290, 292
See application file for complete search history.

(56) References Cited

U.S. PATENT DOCUMENTS

| | | | | |
|---|---|---|---|---|
| 5,420,425 | A | 5/1995 | Bier et al. | |
| 5,783,824 | A | 7/1998 | Baba et al. | |
| 5,847,386 | A * | 12/1998 | Thomson et al. | 250/292 |
| 6,177,668 | B1 | 1/2001 | Hager | |
| 6,403,955 | B1 * | 6/2002 | Senko | 250/292 |
| 6,483,109 | B1 | 11/2002 | Reinhold | |
| 6,504,148 | B1 | 1/2003 | Hager | |

FOREIGN PATENT DOCUMENTS

| | | |
|---|---|---|
| JP | 10-21871 | 1/1998 |
| JP | 2005-183022 | 7/2005 |

* cited by examiner

*Primary Examiner*—Jack I Berman
(74) *Attorney, Agent, or Firm*—Antonelli, Terry, Stout & Kraus, LLP.

(57) ABSTRACT

A mass spectrometry device includes an ion source for ionizing a sample, an ion trap for trapping ions ionized by the ion source. A control unit for controlling voltages applied to lenses forming part of the ion trap, and a detection unit for detecting the ions trapped by said ion trap. The control unit causes a trap potential to be generated on a central axis of quadrupole rods forming part of the ion trap, causes part of the trapped ions to be oscillated in an intermediate direction between the quadrupole rods which are mutually adjacent to each other, and applies a voltage for ejecting the oscillated ions in a central-axis direction of the quadrupole rods by generating an extraction field.

5 Claims, 8 Drawing Sheets

$V_T = 0$ V
$V_E = 0$ V $V_T = 6$ V
$V_E = -20$V

METHOD OF MASS SPECTROMETRY AND MASS SPECTROMETER

CROSS REFERENCE TO RELATED APPLICATION

This application is a divisional application of U.S. application Ser. No. 11/631,033, filed on Dec. 28, 2006, the contents of which are incorporated hereby by reference.

INCORPORATION BY REFERENCE

The present application claims priority from Japanese application JP2005-315625 filed on Oct. 31, 2005, the content of which is hereby incorporated by reference into this application.

TECHNICAL FIELD

The present invention relates to a mass spectrometer and its operation method.

BACKGROUND ART

A linear trap, which allows execution of $MS^n$ spectrometry inside, is widely used for analyses such as proteome analysis. Hereinafter, the explanation will be given below concerning how the mass-selective ejection of ions trapped in the linear trap has been performed in prior arts.

An example of the mass-selective ion ejection in a linear trap is disclosed in U.S. Pat. No. 5,420,425. After ions injected from the axial direction have been accumulated inside the linear trap, the ion isolation or ion dissociation is performed depending on requirements. After that, a supplemental AC field is applied between a pair of mutually-opposed quadrupole rods, thereby making it possible to excite specific ions in the radial direction. Then, the excited ions are mass-selectively ejected in the radial direction by scanning a trapping RF voltage. A pseudo harmonic potential, which is generated by a quadrupole field in the radial direction, is used for the mass separation. This condition allows implementation of high mass resolution.

Also, an example of the mass-selective ion ejection in a linear trap is disclosed in U.S. Pat. No. 6,177,668. After ions injected from the axial direction have been accumulated, the ion isolation or ion dissociation is performed depending on requirements. After that, a supplemental AC voltage is applied between a pair of mutually-opposed quadrupole rods, thereby exciting the ions in the radial direction. Then, the ions excited in the radial direction are mass-selectively ejected in the axial direction by a Fringing Field which occurs between the quadrupole rods and an end lens. Frequency of the supplemental AC voltage, or amplitude value of a trapping RF voltage is scanned. A pseudo harmonic potential, which is generated by a quadrupole field in the radial direction, is used for the mass separation. This condition allows implementation of high mass resolution. In the vicinity of the central axis, influence by the RF voltage is small, and thus ejection energy is low.

Also, an example of the mass-selective ion ejection in a linear trap is disclosed in U.S. Pat. No. 5,783,824. Accumulation of ions injected from the axial direction is performed. Vane lenses are inserted between quadrupole rods. A harmonic potential is generated along the linear-trap axis by a DC bias between the vane lenses and the quadrupole rods. After that, the ions are mass-selectively ejected in the axial direction by applying a supplemental AC voltage between the vane lenses. Voltage of the DC bias or frequency of the supplemental AC voltage is scanned. In the vicinity of the central axis, influence by a RF voltage is small, and thus ejection energy is low.

In U.S. Pat. No. 6,504,148, the disclosure has been made concerning a method of locating the linear trap disclosed in U.S. Pat. No. 6,177,668, and after that, of locating a collision cell and a time-of-flight mass spectrometer. In principle, this method allows a significant enhancement in Duty Cycle of precursor ion scan or neutral-loss scan.

In U.S. Pat. No. 6,483,109, the disclosure has been made concerning a method of locating the linear traps disclosed in U.S. Pat. No. 5,783,824 in large numbers in tandem, and thereby enhancing Duty Cycle of the ions. In this method, the accumulation, isolation, and dissociation of the ions are performed in the different linear traps in parallel. As a result, in principle, this method allows a significant enhancement in the Duty Cycle.

Patent Document 1: U.S. Pat. No. 5,420,425
Patent Document 2: U.S. Pat. No. 6,177,668
Patent Document 3: U.S. Pat. No. 5,783,824
Patent Document 4: U.S. Pat. No. 6,504,148
Patent Document 5: U.S. Pat. No. 6,483,109

DISCLOSURE OF INVENTION

Problem to be Solved by the Invention

It is an object of the present invention to provide a linear trap which exhibits high ejection efficiency, high mass resolution, and low ejection energy. If implementing such a linear trap which satisfies the above-described performances is found to be successful, the employment of such a linear trap permits a significant enhancement in the Duty Cycles as are described in such documents as U.S. Pat. No. 6,504,148 and U.S. Pat. No. 6,483,109.

In the case of U.S. Pat. No. 5,420,425, the ions are mass-selectively ejected in the radial direction. The kV-order voltage to be applied to the quadrupole rods is applied thereto at the time of the ion ejection. Accordingly, range of the ejection energy spreads out to a few hundreds of eV or more. As a result, when converging these ions and trapping these ions using another linear trap, a significant ion loss occurs.

In the case of U.S. Pat. No. 6,177,668, the ions are mass-selectively ejected in the axial direction. As a result, the ions collide with the quadrupole rods at the time of the ion ejection. Consequently, there exists a problem that the ejection efficiency is low, i.e., 20% or less.

In the case of U.S. Pat. No. 5,783,824, the harmonic potential generated by the DC potential is used for the mass separation. As a result, there exists a problem that the mass resolution is lower as compared with the cases of U.S. Pat. No. 5,420,425 and U.S. Pat. No. 6,177,668.

In the patents of such documents as U.S. Pat. No. 6,504,148 and U.S. Pat. No. 6,483,109, the disclosures have been made concerning the Duty-Cycle enhancement methods which are premised on the linear trap which exhibits the high ejection efficiency, high mass resolution, and low ejection energy. No implementable and concrete description, however, has been given regarding the configuration of such a linear trap which satisfies the above-described performances. Also, no publicly-known information on implementation of such types of linear traps has existed up to the present time.

It is an object of the present invention to provide a linear trap which exhibits high ejection efficiency, high mass resolution,. and low ejection energy.

A mass spectrometer and a mass spectrometry method according to the present invention use a mass spectrometer, the mass spectrometer introducing ions produced at an ion source, and including quadrupole rods which have an inlet and an outlet and to which a radio-frequency voltage is applied, the mass spectrometer and the mass spectrometry method including steps of 1) trapping at least part of the ions by a trap potential generated on the central axis of a quadrupole field, 2) oscillating part of the trapped ions in an intermediate direction between the mutually-adjacent quadrupole rods, 3) ejecting the oscillated ions in a central-axis direction of the quadrupole rods by an extraction field, and 4) detecting the ejected ions or introducing the ejected ions into another detection process.

Advantages of the Invention

According to the present invention, it becomes possible to implement the linear trap which exhibits the high ejection efficiency, high mass resolution, and low ejection energy.

Other objects, features and advantages of the invention will become apparent from the following description of the embodiments of the invention taken in conjunction with the accompanying drawings.

EMBODIMENT 1

FIG. 1A to FIG. 1E are configuration diagrams of a mass spectrometry device in which the present-scheme linear trap is carried out. FIG. 1A is an entire diagram of the device, FIG. 1B and FIG. 1C are radial-direction cross-sectional diagrams of the device, and FIG. 1D and FIG. 1E are axial-direction cross-sectional diagrams of an ion trap unit. Also, 1B, 1C, 1D, and 1E in the diagrams indicate that the corresponding diagrams are the cross-sectional diagrams seen in the arrow directions. Ions produced at an ion source 1 (such as electrospray ion source, atmospheric-pressure chemical ion source, atmospheric-pressure photoionization ion source, atmospheric-pressure matrix-assisted laser deserption ion source, and matrix-assisted laser deserption ion source) pass through an orifice 2, then being introduced into a differential pumping region 5. The differential pumping region 5 is exhausted by a pump 20. Next, out of the differential pumping region 5, the ions pass through an orifice 3, then being introduced into a spectrometry unit 6. The spectrometry unit 6 is exhausted by a pump 21, thereby being maintained at $10^{-4}$ Torr or less (i.e., $1.3\times10^{-2}$ Pa or less). Then, after passing through an orifice 17, the ions are introduced into a linear trap unit 7. The linear trap unit 7, into which a bath gas is introduced (not illustrated), is maintained at $10^{-4}$ Torr to $10^{-2}$ Torr (i.e., $1.3\times10^{2}$ Pa to 1.3 Pa). The linear trap unit 7 includes a power supply 19 for controlling voltages at lenses configuring the linear trap unit 7. The ions introduced into the unit 7 are trapped into an area sandwiched by an inlet end lens 11, quadrupole rods 10, forward vane lenses 13, and a trap lens 14. Of the ions trapped into this area, ions with specific mass numbers are resonantly oscillated by a method which will be described later. Then, the oscillated ions are ejected in the axial direction by an extraction field generated by an extraction lens 15. The trap lens 14 and the extraction lens 15 are positioned in the vicinity of the orbit through which the ions pass. Accordingly, a thin-plate-shaped lens or a wire-shaped lens may be used as the lenses 14 and 15. The use of the wire-shaped lens results in a smaller loss of ion transmissivity, but results in a lower machining property of the lens shape. Although the straight-line-shaped trap lens and extraction lens are illustrated in the diagram, in addition thereto, a lens shape for extracting the ions effectively in the axial direction can be optimized using the simulation or the like. Moreover, the ions ejected by the above-described extraction field are accelerated by components such as backward vane lenses 16 and an outlet end lens 12. Then, the ions pass through an orifice 18, then being detected by a detector 8. The component generally used as the detector 8 is an electron multiplier or a type of detector of combination of a scintillator and a photo electron multiplier.

Hereinafter, the explanation will be given below concerning typical applied voltages for the measurement on positive ions. FIG. 2 illustrates its measurement sequences. In some cases, +– a few tens of V is applied to off-set potential of the quadrupole rods 10 by lens voltages before and after the potential. Hereinafter, however, when describing voltages of the respective lenses of the quadrupole rods 10, the voltages are defined as being values at the time when the off-set potential of the quadrupole rods 10 is set at 0. A radio-frequency voltage (i.e., trap RF voltage) (whose amplitude is about 100 V to 5000 V, and whose frequency is about 500 kHz to 2 MHz) is applied to the quadrupole rods 10. At this time, the same-phase trap RF voltage is applied to the mutually-opposed quadrupole rods 10 ((10*a*, 10*c*) and (10*b*, 10*d*) in the diagram: hereinafter, this definition will be followed). Meanwhile, the inverted-phase trap RF voltage is applied to the mutually-adjacent quadrupole rods 10 ((10*a*, 10*b*), (10*b*, 10*c*), (10*c*, 10*d*), and (10*d*, 10*a*): hereinafter, this definition will be followed).

The measurement is performed in accordance with three sequences. At a trap time, the amplitude value of the trap RF voltage is set at about 100 V to 1000 V. As examples of applied voltages to the other lenses, the inlet end lens 11 is set at 20 V, the forward vane lenses 13 are set at 0 V, the trap lens 14 is set at 20 V, the extraction lens 15 is set at 20 V, and the backward vane lenses 16 and the outlet end lens 12 are set at about 20 V respectively. A pseudo potential is generated by the trap RF voltage in the radial direction of a quadrupole field, and a DC potential is generated in the central-axis direction of the quadrupole field. As a result, the ions, which have passed through the orifice 17, are trapped with a substantially 100–% probability into the area sandwiched by the inlet end lens 11, the quadrupole rods 10, the forward vane lenses 13, and the trap lens 14. Length of the trap time is equal to about 1 ms to 1000 ms, which largely depends on the ion introduction quantity into the linear trap unit 7. If the trap time is too long, the ion quantity increases, and thus a phenomenon referred to as "space charge" occurs inside the linear trap. The occurrence of the space charge causes problems to occur which will be described later. An example of these problems is that the position of spectrum mass number shifts at the time of mass scan. Conversely, if the ion quantity is too small, sufficient statistical errors occur. These errors make it impossible to obtain the mass spectrum with a sufficient S/N. In order to select a suitable trap time, it is also effective to monitor the ion quantity by some method or other, and thereby to automatically control the length of the trap time.

Next, at a mass-scan time, the trap-RF-voltage amplitude is scanned from the lower value (100 V to 1000 V) up to the higher value (500 V to 5000 V), thereby ejecting the ions in a sequential manner. The inlet end lens 11, the backward vane lenses 16, and the outlet end lens 12 are set at about −10 V to −40 V, respectively. The trap lens 14 is set at about 3 V to 10 V, and the extraction lens 15 is set at about −10 V to −40 V. Varying the voltage values during the scan makes it possible to obtain the high-resolution spectrum in a wider range. The forward vane lenses 13 are respectively inserted between the mutually-adjacent quadrupole rods 10. A supplemental AC voltage (whose amplitude is 0.01 V to 1 V, and whose frequency is 10 kHz to 500 kHz) is applied between the pair of mutually-opposed forward vane lenses 13*a* and 13*c*. At this time, a direction is selected in which direction of a supplemental resonance field is perpendicular to the direction of the trap lens 14 at 90° and the direction of the supplemental resonance field coincides with the direction of the extraction lens 15 (i.e., the direction of 13*a*-13*c* in the diagram). Although amplitude value of the supplemental AC voltage may be fixed, varying the amplitude value of the supplemental AC voltage during the scan makes it possible to obtain the high-resolution spectrum in a wider range. Ions with specific mass numbers which have resonated are forcefully oscillated in the direction of an intermediate direction 31 between the mutually-adjacent quadrupole rods 10. Then, the ions whose orbit amplitude is enlarged attain to an area where an electric field is generated which occurs by a potential difference ($V_T$-$V_E$) between the trap lens 14 and the extraction lens 15, thereby being ejected in the axial direction. At this time, the following relationship of [Expression 1] exists between the trap-RF-voltage amplitude $V_{RF}$ and the mass number m/z:

$$m/z = \frac{4eV_{RF}}{q_{ej}r_0^2\Omega^2} \qquad \text{[Expression 1]}$$

Here, $r_0$ denotes the distance between the quadrupole rods 10 and the quadrupole center. Also, $q_{ej}$ is a numerical value which can be uniquely calculated from a ratio between each frequency Ω of the trap RF voltage and each frequency ω of the supplemental AC voltage. FIG. 3 illustrates this relationship. As described above, causing $V_{RF}$ and m/z to be related with each other makes it possible to obtain the mass spectrum. Meanwhile, it is also possible to scan the trap RF voltage from the higher value down to the lower value. In this case, the problem of mass cut-off causes a problem to occur that the detectable mass window becomes smaller. Apart from this method, there also exists a method of scanning the frequency of the supplemental AC voltage. For example, when this frequency is scanned from a high frequency (about 200 kHz) down to a low frequency (about 20 kHz), the ions with the corresponding mass numbers are ejected in a sequential manner. Since $q_{ej}$ is the numerical value which depends on angular frequency of the trap RF frequency and angular frequency of the supplemental AC frequency, the scanning of the supplemental AC frequency varies $q_{ej}$. As a result, as is apparent from [Expression 1], m/z corresponding to the ejection varies. When taking only the first-order resonance into consideration, the higher supplemental AC frequency corresponds to lower-mass ions, and the lower supplemental AC frequency corresponds to higher-mass ions. Length of the mass-scan time is equal to about 10 ms to 200 ms, which is substantially proportional to the mass range wished to be detected.

Finally, at an ejection time, all of the voltages are set at 0 V, thereby ejecting all of the ions out of the linear trap. Also, in some cases, an excellent-S/N mass spectrum is integrally calculated by repeating the above-described three sequences. Length of the ejection time is equal to about 1 ms. Incidentally, in addition to the above-described three sequences, it is allowable to set up an ion cleaning time of about a few ms between the respective sequences. By setting the ion cleaning time at a value which is the same as the value on the starting condition of the sequence next thereto, it becomes possible to stabilize initial state of the ions.

FIG. 4 illustrates the mass spectrum obtained as explained so far. A methanol solution of reserpine is electrospray-ionized. The collision dissociation is performed by setting the potential difference in the differential pumping region 5 at a high value. The trap RF frequency is set at 770 kHz, and the supplemental AC frequency is set at 200 kHz. Ion peaks at mass numbers 397 and 398 can be confirmed. From the ion peak at the mass number 397 out of these ion peaks, a high mass resolution (i.e., M/ΔM>800) has been obtained. Also, the ejection efficiency at this time has been found to be high, i.e., 80% or more. Also, because of the axial-direction ejection, the ejection energy is low in principle. Hereinafter, the explanation will be given below regarding the reasons why the high ejection efficiency, the high mass resolution, and the low ejection energy can be implemented in this way.

FIG. 5A and FIG. 5B illustrate results of electric-field simulation in the dot-line area 200 in FIG. 1D. The thicker a portion is, the higher potential it exhibits. Also, contour lines are displayed every 2 V (a contour line of 2.0 V is displayed). The mass number is set at 609, the trap-RF-voltage amplitude is set at 800 V, and the trap-RF-voltage frequency is set at 770 kHz. FIG. 5A illustrates a case where both the trap lens and the extraction lens are set at 0 V. Meanwhile, FIG. 5B illustrates a case where the trap lens is set at 6 V and the extraction lens is set at −20 V. Checking FIG. 5A and FIG. 5B indicates that, only in the case of FIG. 5B, an electric field in the axial direction 201 is generated. This electric field is a direct-current potential which occurs by the potential difference in the axial direction between the trap lens and the extraction lens. As a result, this electric field is easily adjustable. On account of this condition, adjusting this DC potential makes the extraction force adjustable independently of the mass separation by the pseudo potential. On the other hand, in U.S. Pat. No. 6,177,668, the axial-direction electric field is utilized which is caused by a distortion in the end portion of the pseudo potential which occurs by the RF electric field. The extraction force is not a parameter which is independent of the mass separation by the pseudo potential. Accordingly, it is conceivable that the compatibility between the resolution and the ejection efficiency is difficult. Also, as another reason for the high ejection efficiency, in U.S. Pat. No. 6,177,668, the ions are forcefully oscillated between the mutually-opposed quadrupole rods. On account of this, the ions collide with the quadrupole rods with a smaller orbit amplitude. It is estimated that this collision becomes one of the causes for the ion loss. On the other hand, in the present embodiment, the ions are forcefully oscillated in the intermediate direction between the mutually-adjacent quadrupole rods. Consequently, it is estimated that the ions are unlikely to collide with the quadrupole rods, and that the ion loss is comparatively small.

FIG. 6 illustrates execution results of ion-orbit calculations on ions with mass numbers 599, 609, and 619, i.e., the ions whose mass numbers differ by 10 Th. The supplemental AC frequency is set at a frequency (155 kHz) at which the ions with the mass number 609 will resonate. The number of the ions is set at 5, and the calculation time is set at 1 ms. Checking FIG. 6 indicates the following situation: Namely, an ion orbit 101 with the mass number 599 and an ion orbit 103 with the mass number 619 remain converged in the vicinity of the center. The ions with the mass number 609, however, are forcefully oscillated tremendously in the radial direction. Moreover, these ions climb over the trap field, then being effectively ejected in the axial direction. In the first embodiment, the explanation has been given concerning one example of the mass spectrometry device in which the present-scheme linear trap is carried out. In the following embodiments as well, the above-described reasons allow implementation of a linear trap which exhibits high ejection efficiency, high mass resolution, and low ejection energy.

EMBODIMENT 2

FIG. 7A and FIG. 7B are configuration diagrams of a mass spectrometry device in which the present-scheme linear trap is carried out. FIG. 7A illustrates a cross-sectional diagram of the device. The component configuration until attaining to the linear trap and the component configuration subsequent to the linear trap are basically the same as in the first embodiment, and thus will be omitted. In the second embodiment, there exists none of the forward vane lenses which exist in the first embodiment. Also, the quadrupole rods are divided into forward quadrupole rods 50 and backward quadrupole rods 51. The explanation will be given below regarding these points. In the first embodiment, the supplemental AC voltage has been applied between the pair of mutually-opposed forward vane lenses. In the second embodiment, however, the supplemental AC voltage 30 whose phase is inverted is applied to the mutually-adjacent quadrupole rods (50*a*, 50*b* and 50*c*, 50*d*), then being superimposed on the trap RF voltage. On account of this, the ions are forcefully oscillated in the intermediate direction 31 between the mutually-adjacent quadrupole rods. Moreover, the ions are extracted in the axial direction in the extraction area, then being ejected from the orifice 18 of the outlet end lens 12. The second embodiment is basically the same as the first embodiment in the point that the ions are forcefully oscillated in the intermediate direction 31 between the mutually-adjacent quadrupole rods. In the first embodiment, the backward vane lenses have been inserted to which the negative voltage is applied for guiding the ejected ions effectively to the detector. In the second embodiment, in substitution therefor, the backward quadrupole rods 51 are set up. As an applied voltage to the backward quadrupole rods 51, an offset voltage of about −10 V to −40 V is applied with respect to components of the forward RF voltage and the trap RF voltage. In comparison with the first embodiment, the second embodiment makes it possible to reduce the influences which the forward vane lenses exert on the quadrupole field, thereby allowing an enhancement in the mass resolution. However, there also exists a problem that the power supply to be applied to the quadrupole rods becomes complicated.

EMBODIMENT 3

FIG. 8A and FIG. 8B are configuration diagrams of a mass spectrometry device in which the present-scheme linear trap is carried out. FIG. 8A illustrates a cross-sectional diagram of the device. The component configuration until attaining to the linear trap and the component configuration subsequent to the linear trap are basically the same as in the first embodiment, and thus will be omitted. In the third embodiment, in comparison with the first embodiment, there exists neither the extraction lens nor the backward vane lenses. The explanation will be given below regarding this point. In the third embodiment, as is the case with the first and second embodiments, the ions are forcefully oscillated in the intermediate direction 31 between the mutually-adjacent quadrupole rods by the application of the supplemental AC voltage. In the third embodiment, in substitution for the extraction lens, a voltage of about −5 V to −40 V is applied to the outlet end lens 12, thereby generating the extraction field. The ions are extracted in the axial direction in the extraction area, then being ejected from the orifice 18 of the outlet end lens 12. In comparison with the first and second embodiments, the third embodiment provides an advantage of being capable of decreasing the number of the lenses and reducing the cost.

EMBODIMENT 4

FIG. 9 is a configuration diagram of a mass spectrometry device in which the present-scheme linear trap is carried out. The steps starting from the ion source until attaining to the linear trap and the step at which the ions are mass-selectively ejected out of the linear trap are basically the same as in the first embodiment, and thus will be omitted. In the fourth embodiment, the ions which are mass-selectively ejected out of the linear trap are introduced into a collision cell 74. The collision cell 74 includes an inlet end lens 71, multipole rods 75, and an outlet end lens 73. Gases such as nitrogen and Ar of about 1 mTorr to 30 mTorr (i.e., 0.13 Pa to 4 Pa) are introduced in the inside of the collision cell 74. The ions introduced from an orifice 70 are dissociated inside the collision cell 74. At this time, the potential difference between offset potential of the quadrupole rods 10 and offset potential of the multipole rods 75 is set at about 20 V to 100 V. This setting makes it possible to cause the collision dissociation to proceed effectively. Moreover, fragment ions produced by the dissociation pass through an orifice 72 and an orifice 80, then being introduced into a time-of-flight mass spectrometry unit 85. The time-of-flight mass spectrometry unit 85 is exhausted by a pump 22, thereby being maintained at $10^{-6}$ Torr or less (i.e., $1.3\times10^{-4}$ Pa or less). Incidentally, although, in the present embodiment, the collision cell 74 including the four rod-shaped lenses is exemplified, the number of the rods may also be six, eight, ten, or more. Otherwise, a configuration is also allowable where lens-shaped electrodes are arranged in large numbers, and where the RF voltages with different phases are applied to the lens-shaped electrodes respectively. In any case, as long as the configuration is a one which is usable as the collision cell, the present invention is applicable similarly. Furthermore, the fragment ions introduced into the time-of-flight mass spectrometry unit 85 are regularly accelerated in the perpendicular direction by a press-out acceleration lens 81, then being accelerated by an extraction acceleration lens 82. After that, the fragment ions accelerated are reflected by a reflectron lens 83, then being detected by a detector 84 including component such as MCP (: micro channel plate). The mass numbers can be determined from a time elapsing from the press-out acceleration to the detection, and ion intensities can be determined from signal intensities. Accordingly, it becomes possible to obtain the mass spectrum concerning the fragment ions. These fragment ions are the fragment ions originating from the specific-m/z precursor ions ejected out of the linear trap. Consequently, it becomes possible to obtain the three-dimensional mass spectrum by defining masses of the ions ejected out of the linear trap as the first-dimension side, masses of the ions detected in the time-of-flight mass spectrometry unit as the second-dimension side, and the signal intensities as the third-dimension side. From the information like this, it is also possible to obtain information obtained by the precursor ion scan or neutral-loss scan. In addition to the collision dissociation indicated in the fourth embodiment, electron-captured dissociation is implementable by applying a magnetic field to the collision cell thereby to allow incidence of electrons. Also, photo dissociation or the like is implementable by allowing incidence of laser light.

The following modifications are common to the first to fourth embodiments. Namely, a mesh-shaped lens may be used as the outlet end lens or the inlet end lens, and a (thin-plate-shaped) lens whose shape is other then the wire shape can also be used as the trap lens and the extraction lens. Also, as the mass-scan scheme, the plurality of factors, i.e., the trap-RF-voltage frequency, the trap-RF-voltage amplitude, the supplemental-resonance-voltage frequency, and the supplemental-resonance-voltage amplitude, may be simultaneously changed. In whatever case, the essence of the present invention is as follows: Namely, the extraction field in the axial direction is generated in the intermediate direction between the mutually-adjacent quadrupole rods. Simultaneously, the ions are forcefully oscillated in the intermediate direction between the mutually-adjacent quadrupole rods so that the ions can be effectively ejected by the extraction field.

It should be further understood by those skilled in the art that although the foregoing description has been made on embodiments of the invention, the invention is not limited thereto and various changes and modifications may be made without departing from the spirit of the invention and the scope of the appended claims.

Figure 1A:
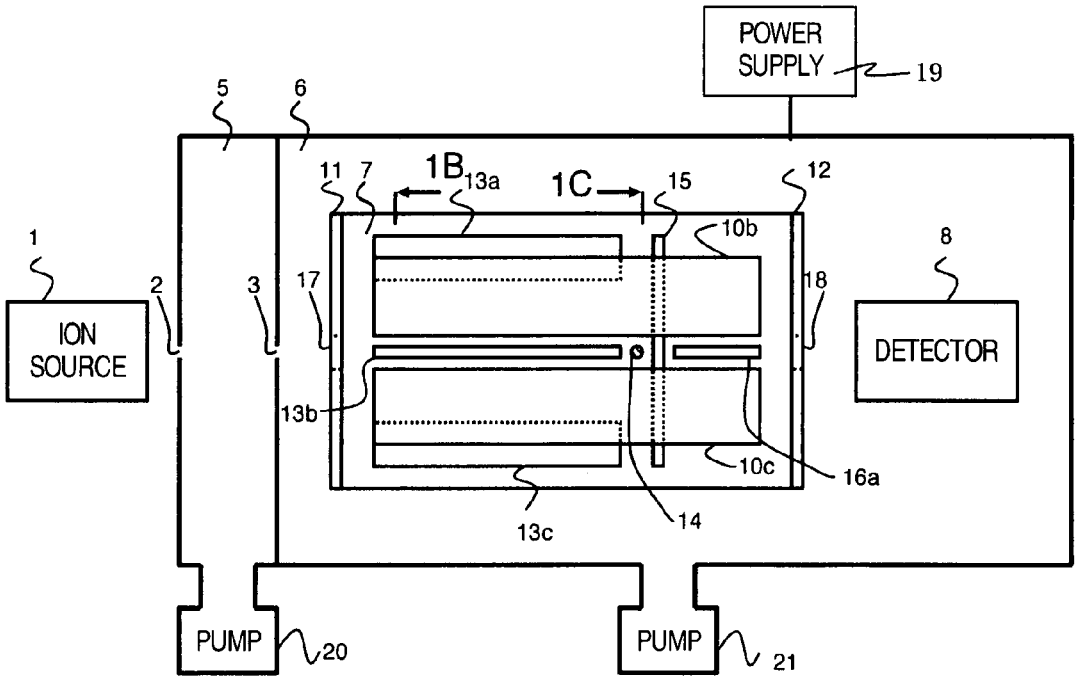
FIG. 1A is a first embodiment of the present invention.
Figure 1B:
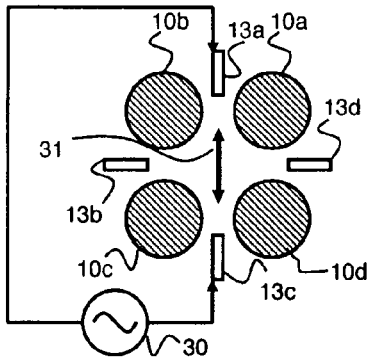
FIG. 1B is a cross-sectional diagram of the first embodiment seen in the direction of an arrow 1B in FIG. 1A.
Figure 1C:
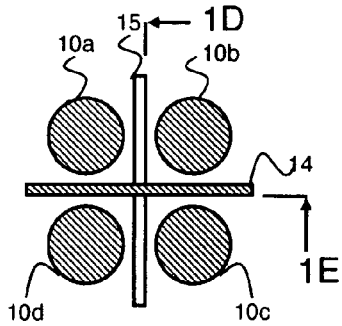
FIG. 1C is a cross-sectional diagram of the first embodiment seen in the direction of an arrow 1C in FIG. 1A.
Figure 1D:
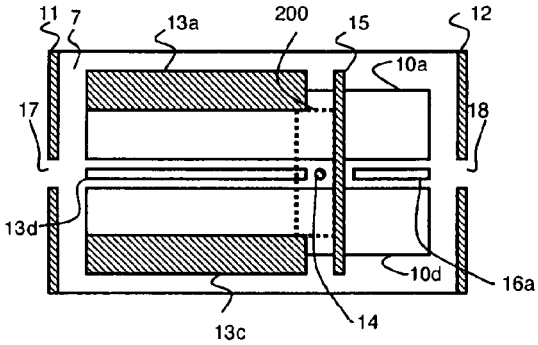
FIG. 1D is a cross-sectional diagram of the first embodiment seen in the direction of an arrow 1D in FIG. 1B.
Figure 1E:
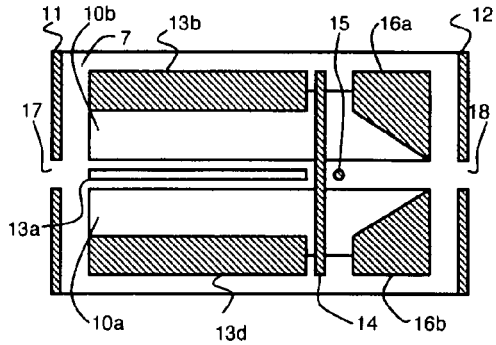
FIG. 1E is a cross-sectional diagram of the first embodiment seen in the direction of an arrow 1E in FIG. 1C.
Figure 2:
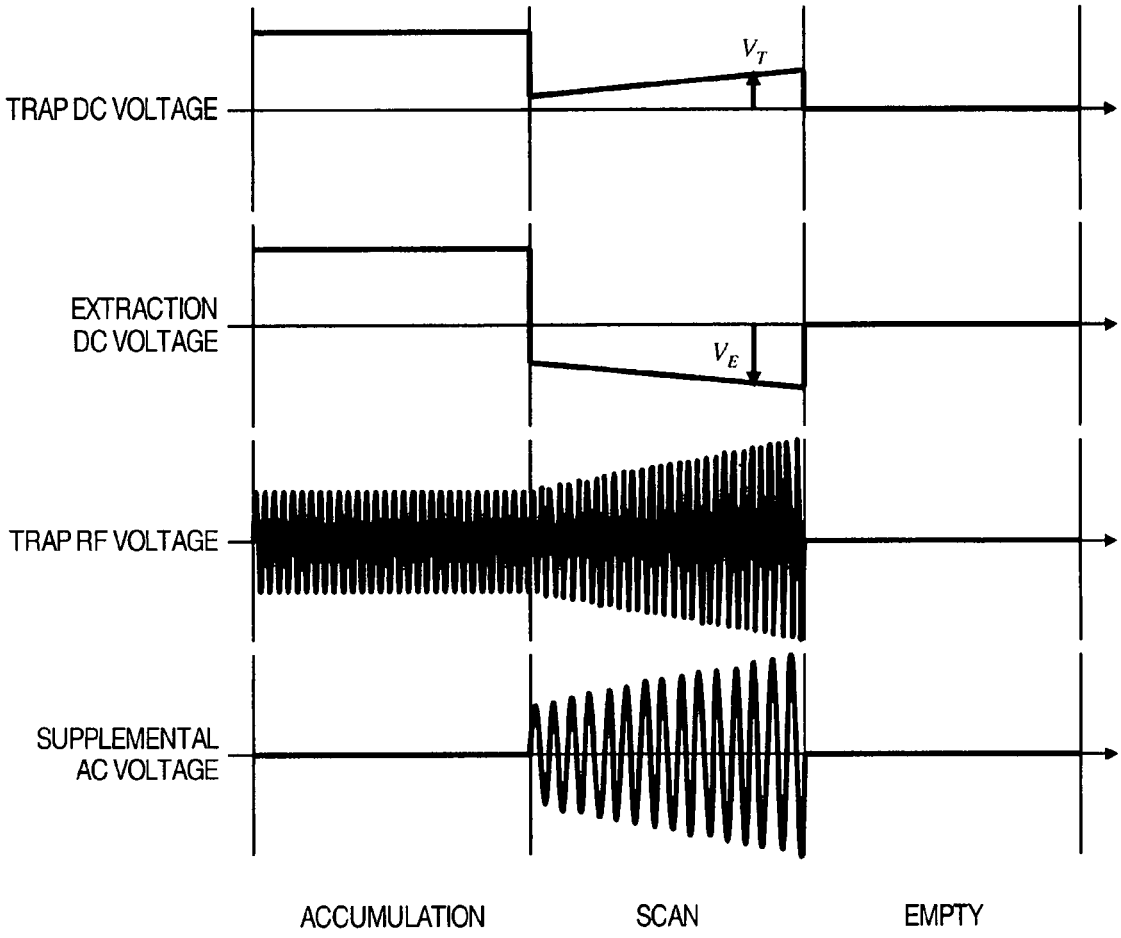
FIG. 2 is measurement sequences in the first embodiment.
Figure 3:
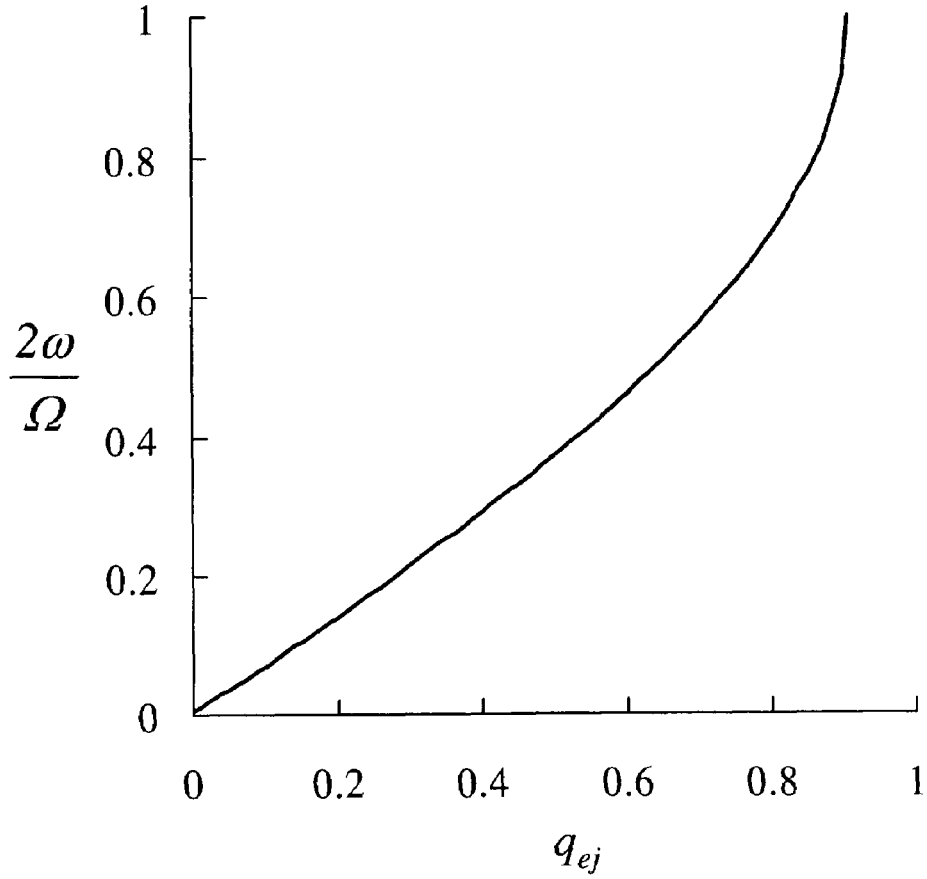
FIG. 3 is an explanatory diagram for explaining effects of the present invention.
Figure 4:
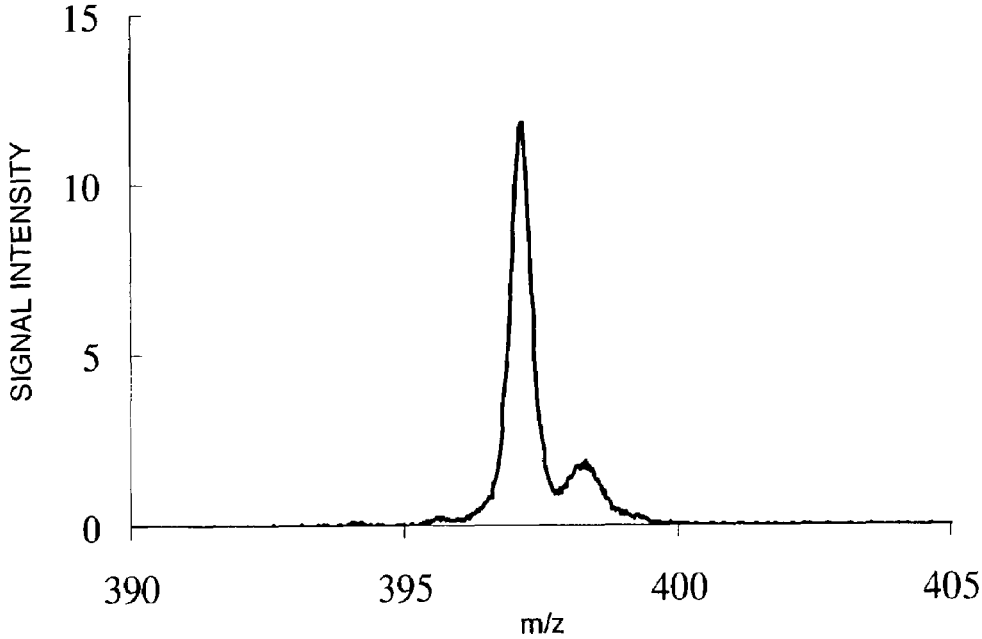
FIG. 4 is an explanatory diagram for explaining the effects of the present invention.
Figure 5A:
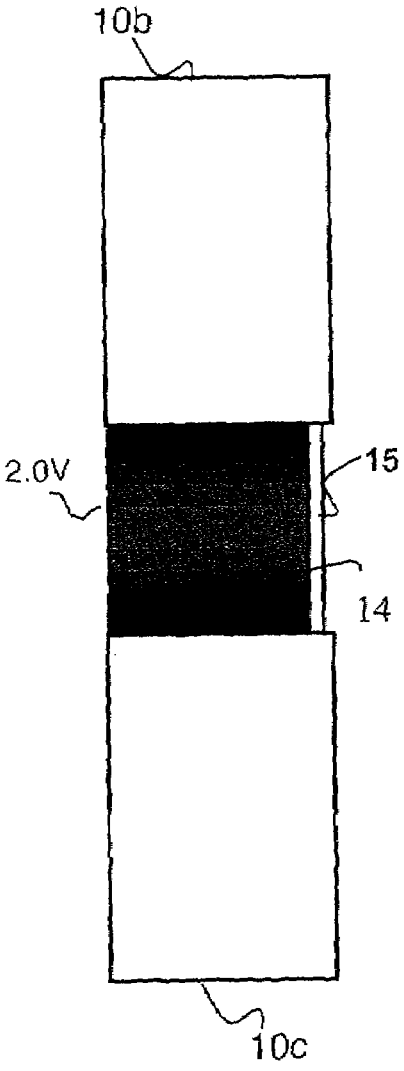
FIG. 5A is an explanatory diagram for explaining the effects of the present invention.
Figure 5B:
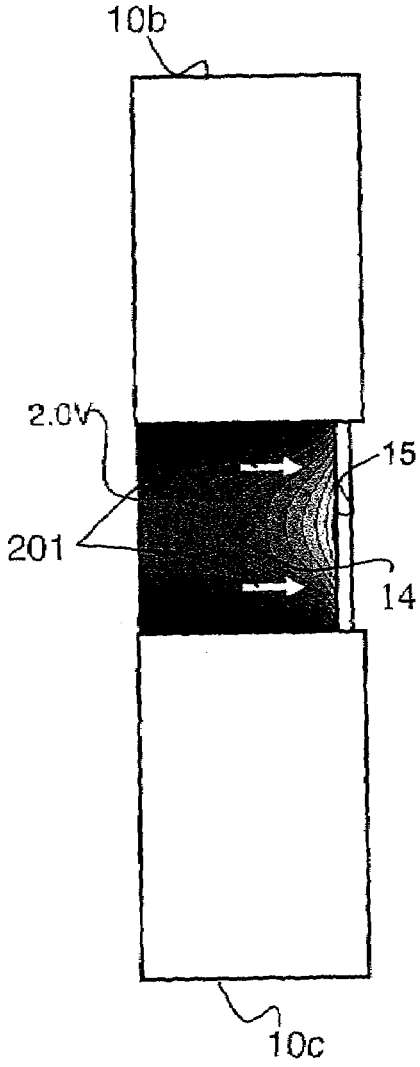
FIG. 5B is an explanatory diagram for explaining the effects of the present invention under another condition.
Figure 6:
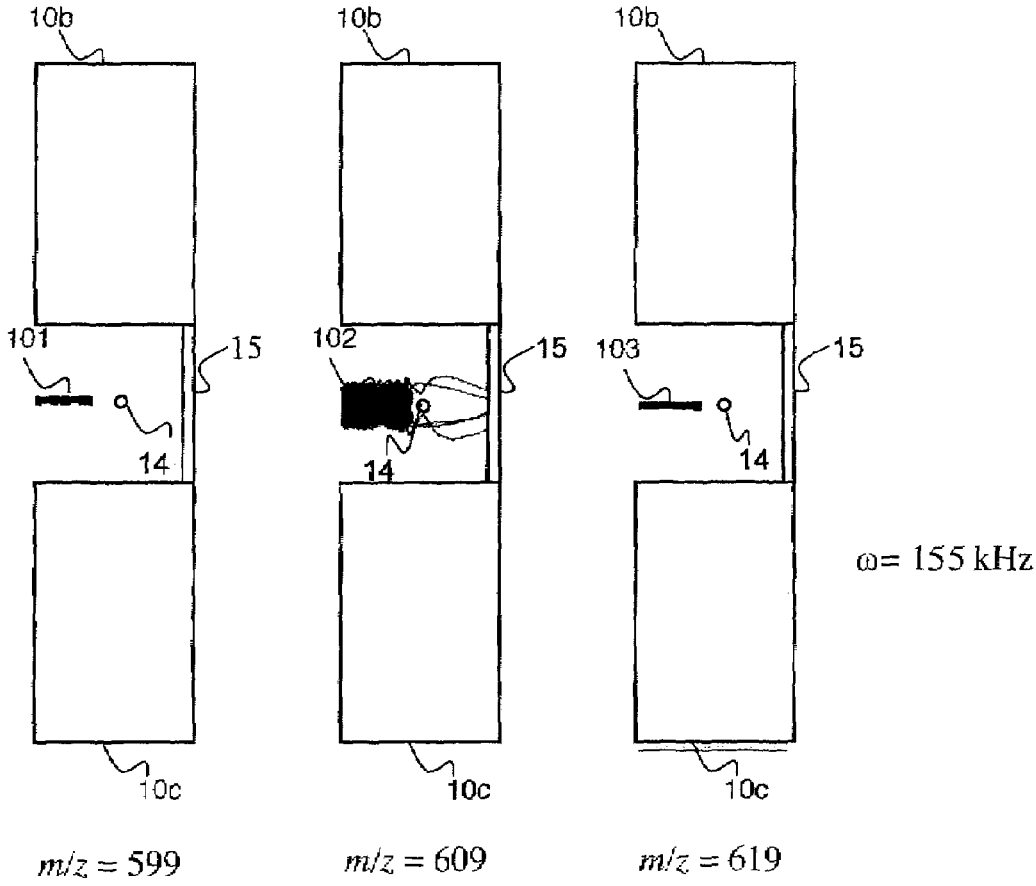
FIG. 6 is an explanatory diagram for explaining the effects of the present invention.
Figure 7A:
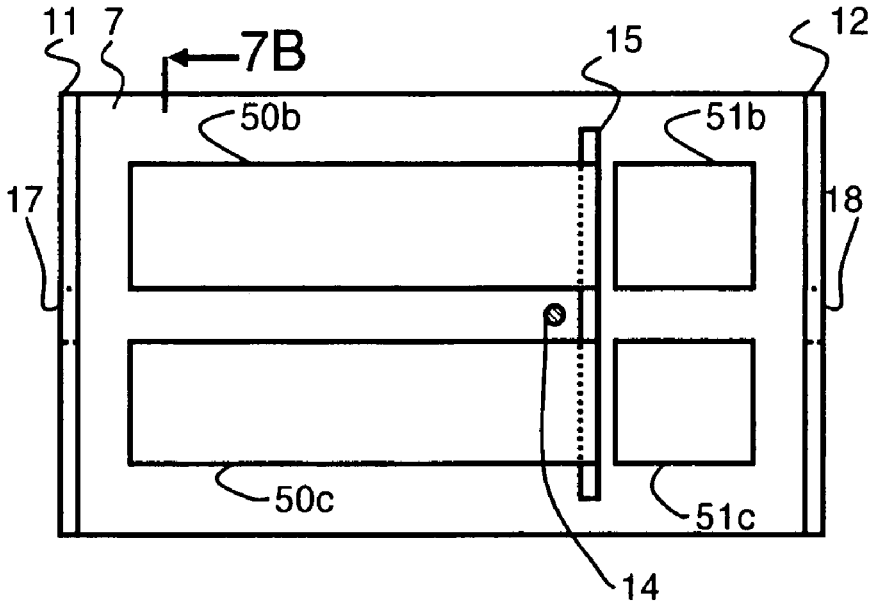
FIG. 7A is a second embodiment of the present invention.
Figure 7B:
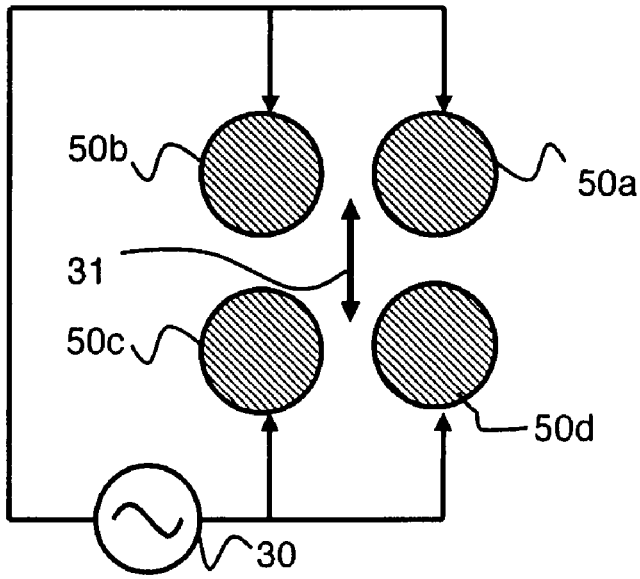
FIG. 7B is a cross-sectional diagram of the second embodiment seen in the direction of an arrow 7B in FIG. 7A.
Figure 8A:
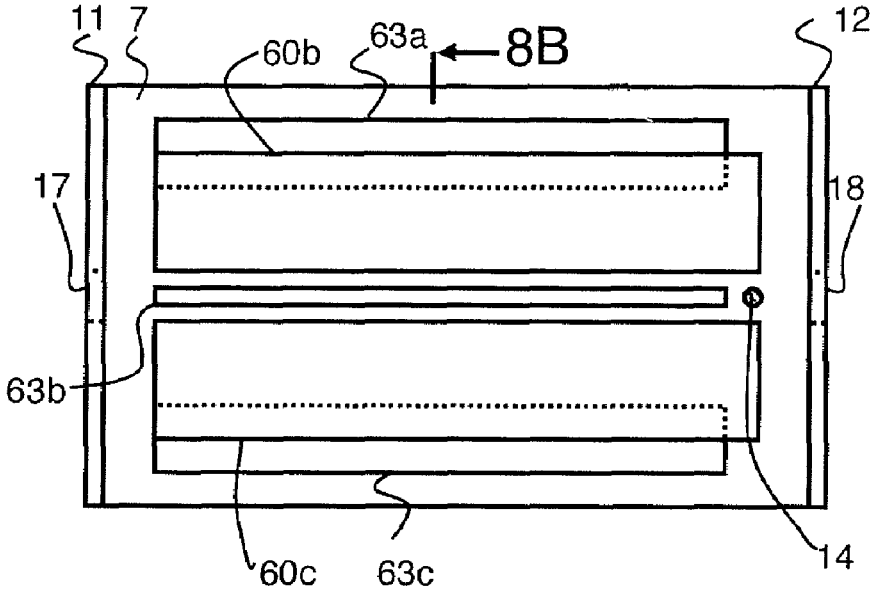
FIG. 8A is a third embodiment of the present invention.
Figure 8B:
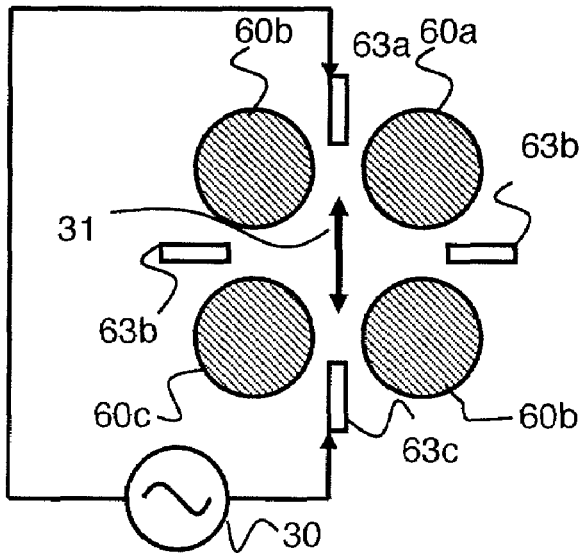
FIG. 8B is a cross-sectional diagram of the third embodiment seen in the direction of an arrow 8B in FIG. 8A.
Figure 9:
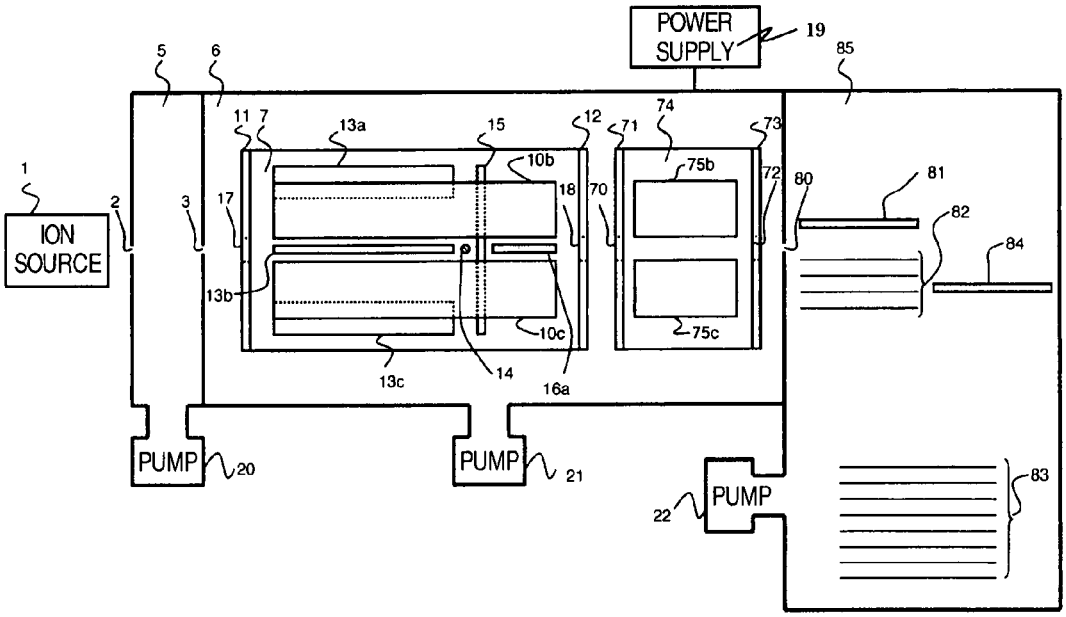
FIG. 9 is a fourth embodiment of the present invention.

The invention claimed is:

1. A mass spectrometry device, comprising:

an ion source for ionizing a sample, an ion trap for trapping ions ionized by said ion source, said ion trap including an inlet end lens, an outlet end lens, quadrupole rods, and a trap lens, a control unit for controlling voltages applied to said lenses configuring said ion trap, and a detection unit for detecting said ions trapped by said ion trap, wherein said control unit causes a trap potential to be generated on central axis of said quadrupole rods, causes part of said trapped ions to be oscillated in an intermediate direction between said quadrupole rods which are mutually adjacent to each other, and applies a voltage for ejecting said oscillated ions in a central-axis direction of said quadrupole rods by generating an extraction field.

2. The mass spectrometry device according to claim 1, wherein said ion trap further comprises a vane lens between said mutually-adjacent quadrupole rods, said control unit causing said ions to be oscillated by applying an AC voltage to said vane lens.

3. The mass spectrometry device according to claim 1, wherein said control unit causes said ions to be oscillated by applying a supplemental AC voltage whose phase is inverted to each of two pairs of said mutually-adjacent quadrupole rods.

4. The mass spectrometry device according to claim 2, wherein said vane lens includes a forward vane lens provided on said inlet side and a backward vane lens provided on said outlet side, said trap lens being provided on said forward-vane-lens side between said forward vane lens and said backward vane lens, an extraction lens for generating said extraction field being provided on said backward-vane-lens side therebetween.

5. The mass spectrometry device according to claim 1, wherein said control unit applies said voltage for generating said extraction field to said outlet end lens.

* * * * *